US005875657A

United States Patent [19]

Kelley

[11] Patent Number: 5,875,657

[45] Date of Patent: Mar. 2, 1999

[54] LOCK WITH REMOVABLE CABLE ADAPTER

[75] Inventor: Donald W. Kelley, The Sea Ranch, Calif.

[73] Assignee: Qualtec Data Products, Inc., Fremont, Calif.

[21] Appl. No.: 813,388

[22] Filed: Mar. 7, 1997

[51] Int. Cl.[6] ..... E05B 73/00

[52] U.S. Cl. ..... 70/18; 70/49; 70/58; 248/553

[58] Field of Search ..... 70/18, 58, DIG. 57, 70/30, 49; 248/551–553

[56] References Cited

U.S. PATENT DOCUMENTS

| | | | |
|---|---|---|---|
| D. 337,040 | 7/1993 | Carl et al. | D8/331 |
| D. 337,041 | 7/1993 | Carl | D8/331 |
| D. 346,733 | 5/1994 | Carl et al. | D8/343 |
| D. 347,987 | 6/1994 | Carl et al. | D8/343 |
| 934,928 | 9/1909 | Michel | 70/423 |
| 1,358,184 | 11/1920 | Voight | 70/58 X |
| 2,383,397 | 8/1945 | Lofqwist | 70/424 |
| 3,101,695 | 8/1963 | Honeyman, Jr. | 70/58 X |
| 3,211,408 | 10/1965 | Schaefer | 248/553 |
| 3,335,585 | 8/1967 | Stratton | 70/58 |
| 3,785,183 | 1/1974 | Sander | 70/58 |
| 3,859,826 | 1/1975 | Singer et al. | 70/58 |
| 4,003,228 | 1/1977 | Lievens et al. | 70/58 |
| 4,055,973 | 11/1977 | Best | 70/58 |
| 4,065,946 | 1/1978 | Loynes et al. | 70/58 |
| 4,300,371 | 11/1981 | Herwick et al. | 70/58 |
| 4,667,491 | 5/1987 | Lokken et al. | 70/18 X |
| 4,938,040 | 7/1990 | Humphreys, Jr. | 70/58 |
| 4,979,382 | 12/1990 | Perry | 70/58 |
| 5,022,536 | 6/1991 | Pierson | 70/58 X |
| 5,050,836 | 9/1991 | Makous | 248/553 |
| 5,076,079 | 12/1991 | Monoson et al. | 248/553 X |
| 5,082,232 | 1/1992 | Wilson | 248/551 |
| 5,325,686 | 7/1994 | Bentley | 70/58 |
| 5,327,752 | 7/1994 | Myers et aL. | 70/58 |
| 5,351,507 | 10/1994 | Derman | 70/18 |
| 5,381,685 | 1/1995 | Carl et al. | 70/78 |
| 5,493,878 | 2/1996 | Murray, Jr. et al. | 70/58 |
| 5,502,989 | 4/1996 | Murray, Jr. et al. | 70/58 |

FOREIGN PATENT DOCUMENTS

| | | | |
|---|---|---|---|
| 877220 | 12/1942 | France | 70/164 |
| 1085107 | 1/1955 | France | 70/14 |
| 2800980 | 7/1978 | Germany | 70/18 |
| 451949 | 10/1949 | Italy . | |
| 14095 | 5/1905 | Norway | 70/424 |

OTHER PUBLICATIONS

Product Description: Kensington® MicroSaver® Security Systen, Kensington Microware Limited, Feb. 1992.

Product Description: Qualtec® Stop Theft™ PC Security Solutions, Qualtec Data Products, 1995, See Notebook–Kit and MacIntosh Security.

*Primary Examiner*—Lloyd A. Gall

*Attorney, Agent, or Firm*—Fliesler, Dubb, Meyer & Lovejoy LLP

[57] ABSTRACT

A security device for securing a first object having an aperture to a second object by a cable. The device comprises a self contained locking unit for securing the device to the first object and a cable adapter having a top, a bottom and a cable housing. The cable housing receives a connector attached to an end of the cable after the cable is attached to the second object. The cable adapter receives the locking unit which will extend out of both the top and bottom of the cable adapter. The locking unit prevents the connector of the cable from being removed from the cable adapter when the locking unit is received by the cable adapter. The connector can be removed from the cable adapter when the locking unit is not being received by the cable adapter.

1 Claim, 4 Drawing Sheets

FIGURE 10A
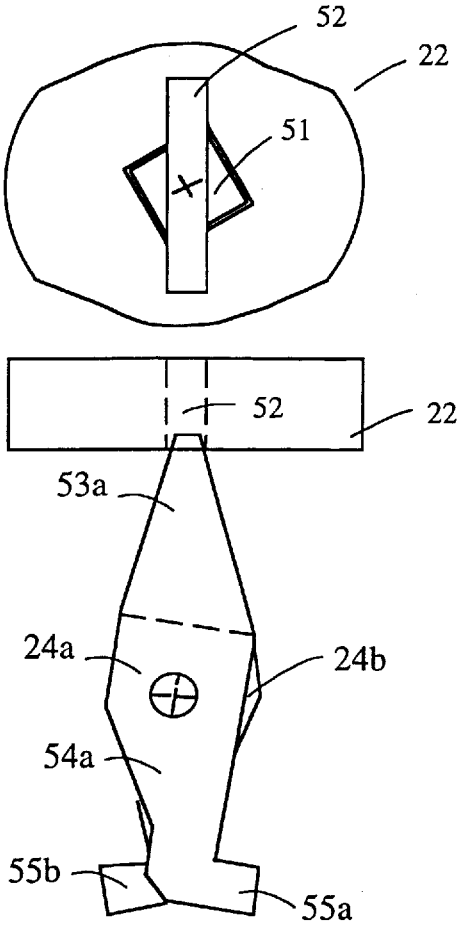
FIGURE 10B
FIGURE 11A
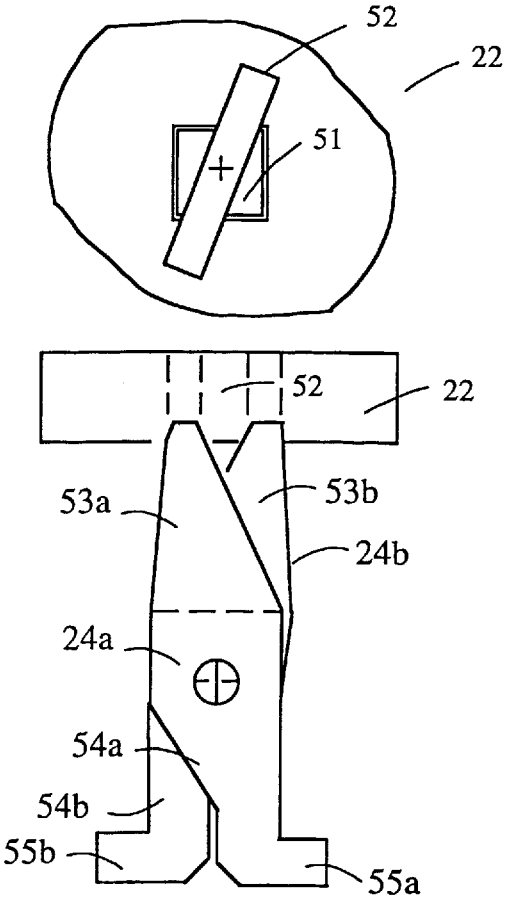
FIGURE 11B
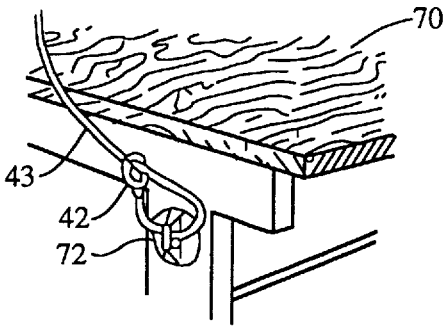
FIGURE 12
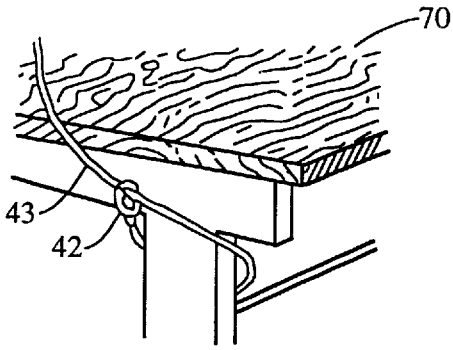
FIGURE 13

LOCK WITH REMOVABLE CABLE ADAPTER

BACKGROUND OF THE INVENTION

1. Field of the Invention

The present invention generally relates to a locking mechanism and a removable cable adapter and more specifically relates to a locking mechanism and a removable cable adapter for use in securing business equipment such as printers, scanners and portable computers and other portable objects in a location.

2. Description of the Related Art

Manufacturers of portable computers, such as lap top computers, and other portable objects, such as printers, scanners, copiers and modems, are providing a standardized and dedicated locking aperture within the body of the portable computer or other equipment. The locking aperture is so located that the equipment may still be operated when secured in a location by a locking apparatus. Where such a locking aperture is not provided in the equipment, a locking aperture structure that can be permanently connected to such equipment is available on the market.

Many different locking apparatuses have been developed to secure the equipment at a location using a locking aperture. Product have been developed for locking down equipment, using a locking aperture on or attached to the equipment, where a cable is permanently attached to the locking apparatus. Examples of such securing devices can be found in U.S. Pat. Nos. 4,938,040, 5,327,752, 5,493,878 and 5502,989. A locking apparatus having a permanently attached cable may experience problems where it is desired to have the cable used not only for locking down the object having the locking aperture but also to lock down other equipment such as printers by the same cable.

SUMMARY OF THE INVENTION

It is an object of the present invention to provide a cable adapter and a locking apparatus that coact to secure one end of a cable to an object using the locking aperture in or connected to the object.

Briefly the invention comprises a key operated lock structure that moves a pair of arms between open and closed positions as a key inserted into the lock is rotated between open and closed positions. A cable adapter allows one end of the lock structure to pass through the cable adapter such that when the lock structure is inserted through a locking aperture in a given object and then locked, the cable adapter cannot thereafter be removed from the lock structure until the locking structure is unlocked and removed from the object. The cable adapter includes a compartment for receiving one end of a cable which is locked in place when the lock structure is inserted through the cable adapter.

BRIEF DESCRIPTION OF THE DRAWINGS

The invention will be described with respect to the particular embodiments thereof and references will be made to the drawings, in which:

FIGS. 10A and 10B illustrates the relationship of the scissor arms to the cam when the scissor locking unit is unlocked;

FIGS. 11A and 11B illustrates the relationship of the scissor arms to the cam when the scissor locking unit is locked;

FIG. 12 illustrates a first way of connecting a cable to a structure; and

FIG. 13 illustrates a second way of connecting a cable to a structure.

DETAILED DESCRIPTION OF THE INVENTION

Figure 1:
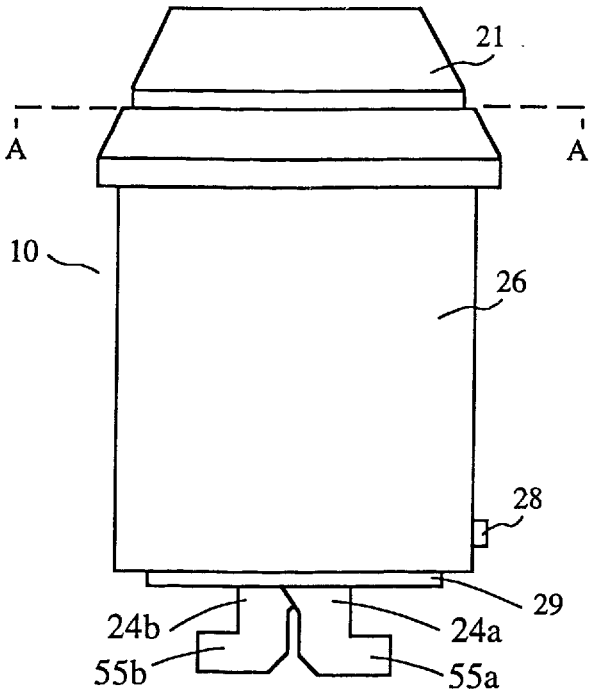
FIG. 1 is a plan view of a lock structure.
Figure 9:
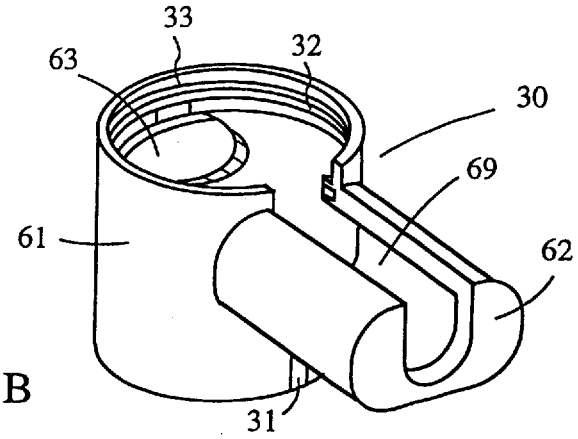
FIG. 9 is an isometric view of the cable adapter of the invention.

A locking unit 10 of FIG. 1 and a cable adaptor 30 of FIG. 9 comprise the two major elements of the invention. Locking unit 10 is described herein as a scissor locking unit 10 within the specification however other mechanical locking structures can be used to control a pair of engagement ends 55*a* and 55*b* such as those described in the United States patents referenced above.

Figure 3:
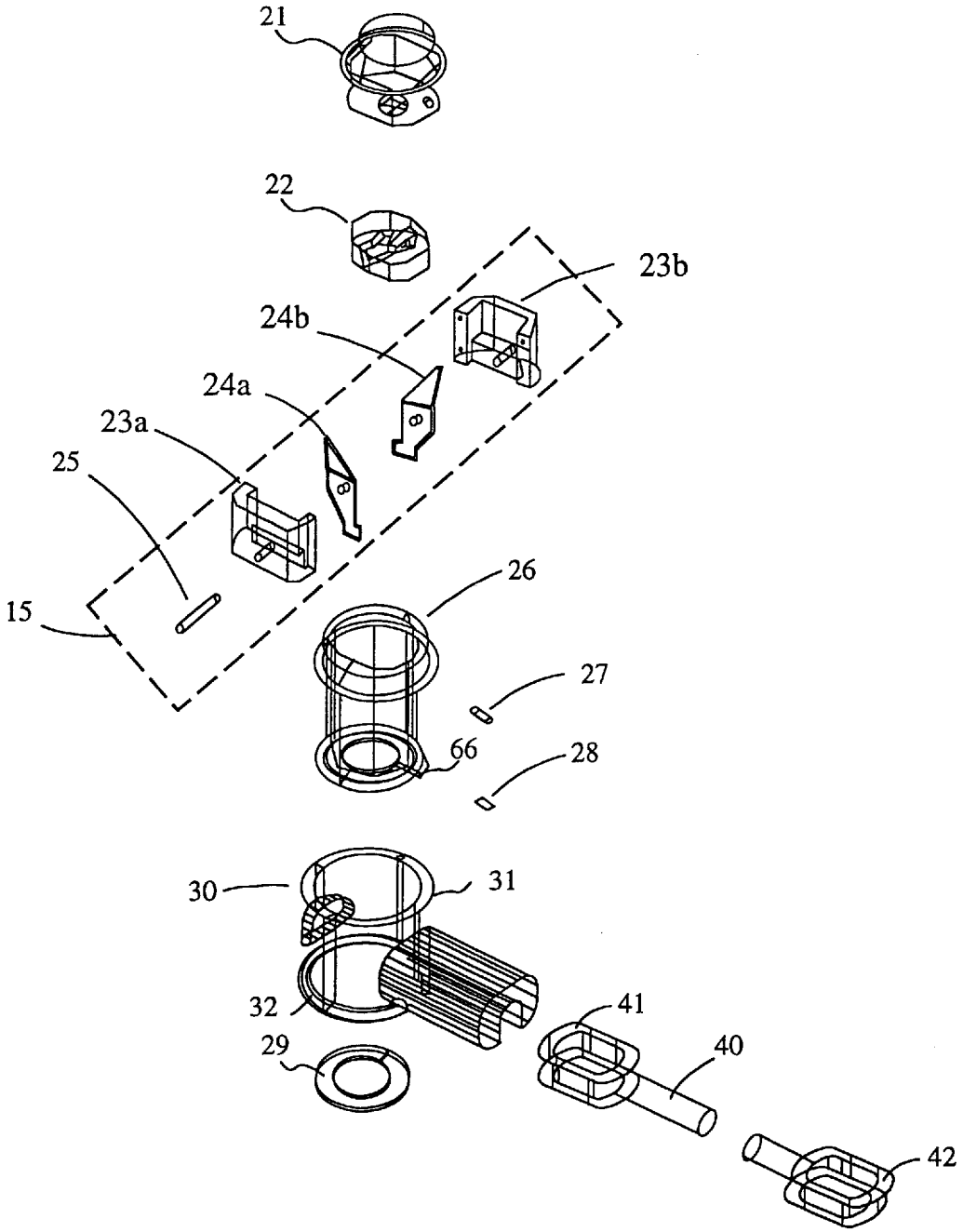
FIG. 3 is an exploded wire drawing view of a lock structure and a cable adapter of the invention.
Figure 4:
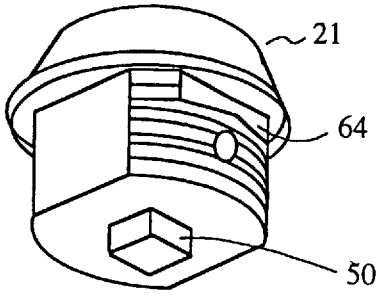
FIG. 4 is a front view of the lock component of the scissor locking unit.
Figure 7:
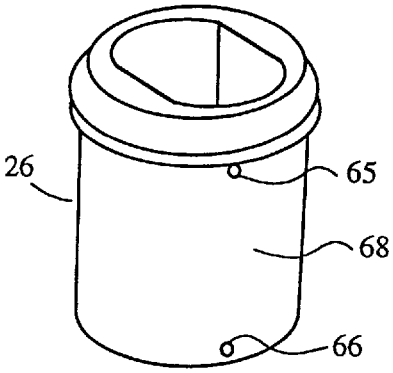
FIG. 7 is an isometric view of the sleeve component of the scissor locking unit.

FIG. 1 shows an assembled scissor locking unit 10 of the invention. At the top of the scissor locking unit 10 a key operated lock 21 is provided for operating scissor arms 24*a* and 24*b*. Referring to FIGS. 3, 4 and 7, lock 21 is securely mounted in sleeve 26 by pin 27 being force-fitted through hole 65 in sleeve 26 into mounting slit 64. Engagement end 55*a* of scissor arm 24*a* and engagement end 55*b* of scissor arm 24*b* extend from the bottom of sleeve 26. Seal 29 is provided to form a non-abrasive surface that will be in contact with the portable computer or portable object.

FIG. 3 is a wire diagram showing an exploded view of scissor locking unit 10, a cable adapter 30 and a cable 40. As shown in FIGS. 3 and 4, lock 21 is a standard commercially available key lock except that the shaft 50 of lock 21 has been machined preferably into a square shaft 50. Shaft 50 will rotate as an inserted key (not shown) into lock 21 is rotated.

Figure 5:
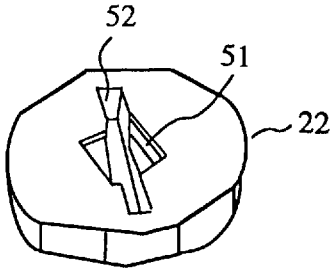
FIG. 5 is an isometric view of the cam component of the scissor locking unit.

As shown in FIGS. 3, 5 and 7, a cam 22 is provided having a square shaft receiving compartment 51 and translation slot 52 therein. Shaft 50 of lock 21 is inserted into the shaft receiving compartment 51 of cam 22 such that cam 22 will rotate as shaft 50 is rotated. Cam 22 is designed to rotate within sleeve 26. Shaft 50 and shaft receiving compartment 51 are not limited to a square structure but may take the form of any interlocking structure such as a rectangle, a triangle, a hexagon, etc.

Figure 6:
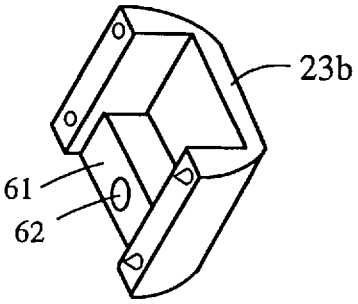
FIG. 6 is an isometric view of one half of the clamp component of the scissor locking unit.

FIG. 3 shows a scissor pivot assembly 15 formed from clamps 23*a* and 23*b*, scissor arms 24*a* and 24*b* and pivot pin 25. FIGS. 3 and 6 show clamp 23*b* to include bar 61 with pivot hole 62 therein. Clamp 23*a* is made identical to clamp 23*b* such that when the clamps 23*a* and 23*b* face each other as shown in FIG. 3 the two clamps will mate with each other to form a scissor housing into which scissor arms 24*a* and 24*b* are mounted by means of pivot pin 25.

Figure 8A:
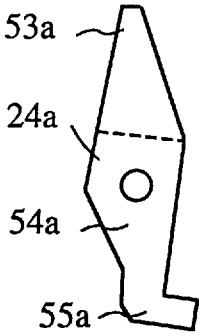
FIGS. 8A and 8B is a front and side view respectively of a scissor arm of the scissor locking unit.
Figure 8B:
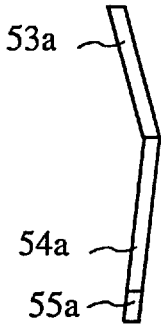

FIGS. 8A and 8B shows scissor arm 24*a* to include a translation portion 53*a* and a bottom portion 54*a* which terminates in engagement end 55*a*. The translation portion 53*a* has a truncated right triangle shape which is bent away from the vertical bottom portion 54*a*. Scissor arm 24*b* is made identical to scissor arm 24*a* such that when the scissor arms 24*a* and 24*b* face each other as shown in FIG. 3, the two translation portions 53*a* and 53*b* will extend away from each other, thereby allowing freedom of movement for the scissor arms 24*a* and 24*b* about pivot pin 25 in the scissor pivot assembly 15. The translation portions 53*a* and 53*b* extend into opposite sides of translation slot 52 in cam 22. As cam 22 is rotated, the structure of the scissor arms will translate the rotory motion of the cam 22 into linear motion of the engagement end 55*a* and 55*b* of bottom portion 54*a* and 54*b* of scissor arms 24*a* and 24*b* respectively.

Referring to FIGS. 3 and 7, a seal 29, made of rubber or plastic, is attached to the bottom of sleeve 26 for providing a non-abrasive bottom surface for the scissor locking unit 10. Seal 29 is securely mounted in sleeve 26 by adhesive or by a force fitting.

Referring to FIGS. 2, 3, 7 and 9, key pin 28 is force fitted into blind hole 66 in sleeve 26 to provide a means for keying and holding scissor locking unit 10 within cable adapter 30. Cable adapter 30 has a key slot 31 through which key pin 28 passes to gain access to locking groove 32 in sleeve 30. Locking groove 32 has an internal stop 33. In practice, scissor locking unit 10 is first oriented by key pin 28 to key slot 31 in cable adapter 30 and then scissor locking unit 10 is moved down through key slot 31 into cable adapter 30 and positioned such that key pin 28 is aligned with locking groove 32 in cable adapter 30. Scissor locking unit 10 is then rotated in either direction such that key pin 28 is engaged at the stop in locking groove 32 thereby securing scissor locking unit 10 within cable adapter 30 and for preventing scissor locking unit from being rotated a full 360 degrees within cable adapter 30. When scissor locking unit 10 is so inserted into cable adapter 30, key operated lock 21 will extend from the top of cable adapter 30 and the bottom surface of seal 29 and engagement end 55*a* of scissor arm 24*a* and engagement end 55*b* of scissor arm 24*b* will extend from the bottom of cable adapter 30.

FIGS. 3 and 9 show the cable adapter 30 having a ring portion 61 which has an inner diameter greater than the outer diameter of the lower portion 68 of sleeve 26. A cable 40 is shown having both ends of cable 40 terminated with eye connector 41 and 42. The cable alternatively may have the end to be received by cable adapter 30, referred to as the adapter end of the cable, terminated in another form such as an enlarged sleeve or a ball structure. The size of the eye in eye connector 40 is large enough to allow the connector, whether it take the form on an enlarged sleeve, ball or another eye connector, at the adapter end of cable 40 to pass through that eye connector's eye.

Cable adapter 30 has a connection housing 62 designed to receive and hold the connector at the adapter end of the cable. The cable adapter 30 will hereinafter be discussed for use having an eye connector at the adapter end of the cable.

Cable adapter 30 has an eye connector housing 62 which is large enough to house eye connector 41 or 42 of cable 40. An insertion hole 63 in ring 61 and an insertion slot 69 in eye connector housing 62 are provided to ease the insertion of an eye connector into the eye connector housing 62.

Figure 2:
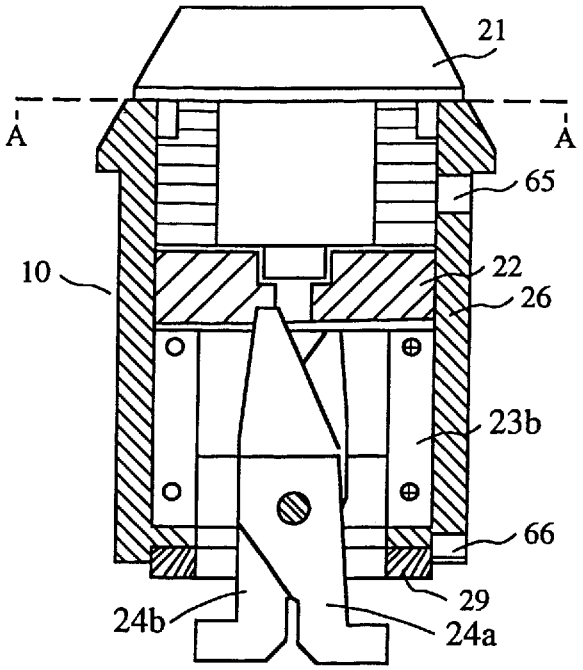
FIG. 2 is a cross section view illustrating the assembly of the various components of a scissor lock structure.

FIG. 2 illustrates the relative positions of the various components of the scissor locking unit 10. Sleeve 26, cam 22 and seal 29 have been sectioned along line A—A and clamp 23*a* has been omitted to expose other components in the scissor locking unit 10. Lock 21 is shown inserted into sleeve 26 with shaft 50 being housed in receiving compartment 51 of cam 22. Clamp 23*b* is shown inside sleeve 26 and supporting scissor arms 24*a* and 24*b* upon pivot pin 25. Translation portion 53*a* and 53*b* of scissor arms 24*a* and 24*b* respectively are shown as extending into translation slot 52 of cam 22.

FIG. 10A and 10B illustrates cam 22 and the scissor arms 24*a* and 24*b* in the unlocked position. In the unlocked position the translation slot 52 will cause the ends of the translation portions 53*a* and 53*b* to be aligned over each other such that the engagement ends 55*a* and 55*b* of bottom portions 54*a* and 54*b* respectively will also overlap. When in the open position the engagement ends 55*a* and 55*b* can be inserted into the adapter hole in the portable computer or other portable objects.

FIG. 11A and 11B illustrates cam 22 and the scissor arms 24*a* and 24*b* in the locked position. In the locked position the translation slot 52 will cause the ends of the translation portions 53*a* and 53*b* to not be aligned over each other and spaced apart from each other such that the engagement ends 55*a* and 55*b* of bottom portions 54*a* and 54*b* respectively will be linearly moved apart. When in the closed position the engagement ends 55*a* and 55*b* can not be removed out of the adapter hole in the portable computer or other portable objects. Further the engagement ends and the scissor arms may be so designed that when in the closed position the engagement ends 55*a* and 55*b* come into contact with the sides of the adapter hole and/or the inside of the housing having the adapter hole.

In that the cable 40 is not permanently attached to the cable adapter 30, the cable may first be secured to a structure.

FIG. 12 illustrates such a connection by passing eye connector 41 of the cable 40 first through a holding bracket 72 on structure 70 and then through eye connector 42 of cable 40. Eye connector 41 of cable 40 may then be inserted in eye connector housing 62 in cable adapter 30.

FIG. 13 illustrates another such connection passing eye connector 41 of the cable 40 first through structure 70 and then through eye connector 42 of cable 40. Eye connector 41 of cable 40 may then be inserted in eye connector housing 62 in cable adapter 30.

In use, the cable is attached to a structure and then the adapter end of the cable is passed through holding brackets, such as the holding bracket 72 of FIG. 12, attached to various other objects, if any, that are to be locked down. The adapter end of the cable is then placed into connector housing 62. A locking unit 10, in an unlocked mode, is then inserted into cable adapter 30, as previously described, thereby securing the adapter end of the cable in the cable housing 62 of the cable adapter 30. The engagement end 55*a* and 55*b* are inserted through the locking aperture in an object, the key for the lock is then used to cause the engagement ends 55*a* and 55*b* to engage the object thereby effectively securing the cable to the object.

While the invention has been particularly shown and described with references to the preferred embodiments thereof, it will be understood by those skilled in the art that changes in form and detail may be made therein without departing from the spirit and scope of the invention. Given the above disclosure of general concepts and specific embodiments, the scope of the protection sought is defined by the following.

What is claimed is:

1. A security device adapted to be attached to an object through an aperture in said object and adapted to receive a connector attached to one end of a removable cable, said device comprising:

a self contained locking unit comprising:

a first portion having a first length and a first width;

a second portion having a second length and second width where said second width is less than said first width; and a securing means extending from said second portion for securing said device to said object through said aperture, said securing means having a first position and a second position where only said securing means of said security device is inserted into said object through said aperture when said securing means is in said first position and where said securing means once inserted into said object through said aperture in said object cannot be removed from said object through said aperture when said securing means is in said second position thereby securing said security device directly to said object; and a cable adapter comprising:

a cable housing for receiving and housing within said cable housing said connector attached to said end of said cable where said connector can freely be inserted into and removed from said cable housing; and an internal passageway extending through said cable adapter for receiving said locking unit, said internal passageway having a third length and a third width where said third length is equal to or less than said second length and said third width is less than said first width and greater than said second width;

said cable adapter being positioned between said first portion of said locking unit and said securing means extending from said second portion of said locking unit, said second portion of said locking unit directly preventing and blocking a connector housed within said cable housing from being removed from said cable housing whenever said cable adapter is so positioned with reference to said locking unit; and said cable adapter being captured between said first portion of said locking unit and said object when said second portion is present in said internal passageway and said securing means of said locking unit is inserted into said object through said aperture in said object.

* * * * *